US008925535B2

(12) United States Patent
Phillips

(10) Patent No.: US 8,925,535 B2
(45) Date of Patent: Jan. 6, 2015

(54) HAND-POWERED PROJECTILE ASSEMBLY

(71) Applicant: Pocket Shot LLC, Marietta, GA (US)

(72) Inventor: Shawn Phillips, Marietta, GA (US)

(73) Assignee: Pocket Shot LLC

( * ) Notice: Subject to any disclaimer, the term of this patent is extended or adjusted under 35 U.S.C. 154(b) by 24 days.

(21) Appl. No.: 13/712,953

(22) Filed: Dec. 12, 2012

(65) Prior Publication Data

US 2014/0158103 A1 Jun. 12, 2014

(51) Int. Cl.
*F41B 3/02* (2006.01)
*F41B 7/08* (2006.01)

(52) U.S. Cl.
CPC .... *F41B 7/08* (2013.01); *F41B 3/02* (2013.01)
USPC ..... 124/20.1

(58) Field of Classification Search
CPC ..... F41B 3/02
USPC ..... 124/20.1, 20.2, 20.3
See application file for complete search history.

(56) References Cited

U.S. PATENT DOCUMENTS

| | | | | | |
|---|---|---|---|---|---|
| 849,554 | A * | 4/1907 | Middleton | 124/21 |
| 1,072,988 | A | 9/1913 | Pratt | |
| 1,207,025 | A | 12/1916 | Grigsby | |
| 1,487,973 | A | 3/1924 | Preston | |
| 3,154,050 | A | 10/1964 | Hanson | |
| 3,618,585 | A | 11/1971 | Allison | |
| 4,125,106 | A * | 11/1978 | Kelly | 124/17 |
| 5,224,703 | A * | 7/1993 | Osher | 473/513 |
| 6,814,644 | B2 | 11/2004 | Nelson et al. | |
| 7,464,701 | B1 * | 12/2008 | Mendoza et al. | 124/27 |

* cited by examiner

*Primary Examiner* — John Ricci
(74) *Attorney, Agent, or Firm* — Alston & Bird LLP

(57) ABSTRACT

A hand-powered projectile assembly is provided for launching projectiles. The hand-powered projectile assembly includes an elastic projectile pouch, a hollow base ring and a hollow locking ring. The elastic projectile pouch having an open end is attached to the hollow base ring. The hollow base ring is attached to the locking ring. The hollow locking ring further maintains a tight seal with the elastic projectile pouch. The hand-powered projectile assembly further includes a cap to maintain the position of the projectiles inside the elastic projectile pouch. The cap maintains a watertight connection with the hollow base ring. The projectile exits through the open end of the elastic projectile pouch and the hollow base ring.

21 Claims, 9 Drawing Sheets

HAND-POWERED PROJECTILE ASSEMBLY

BACKGROUND OF THE INVENTION

This invention generally relates to a device for launching projectiles, and more particularly relates to a hand-powered projectile assembly including an elastic projectile pouch to launch and store a projectile.

A slingshot is a small hand-powered projectile weapon. The classic form consists of a Y-shaped frame held in the off hand, with two rubber strips attached to the uprights. The other ends of the strips lead back to a pocket which holds the projectile. The pocket is grasped by the dominant hand and drawn back to the desired extent to provide power for the projectile (up to a full span of the arms with sufficiently long bands).

While early slingshots were most associated with young vandals, they were also capable hunting arms in the hands of a skilled user. Firing metallic projectiles, such as lead musket balls or buckshot, or steel ball bearings, the slingshot was capable of taking game such as quail, pheasant, rabbit, and dove. Placing multiple balls in the pouch produces a shotgun effect, such as firing a dozen BBs at a time for hunting small birds.

Various types of slingshots are available in the market. Most of the slingshots include a fork shaped stem, an elastic member connected to the fork stem and a strip connected to the elastic member to hold a projectile. The elastic member is stretched along with the projectile and then the projectile is released to hit a predetermined target.

Related patents known in the art include the following: U.S. Pat. No. 1,072,988, issued to Pratt et al. on Sep. 9, 1913, U.S. Pat. No. 1,207,025, issued to Grigsby on Dec. 5, 1916, U.S. Pat. No. 1,487,973, issued to Preston on Mar. 25, 1924, and U.S. Pat. No. 3,618,585, issued to Allison on Nov. 9, 1971.

Conventional slingshots do not have the capacity to store the projectiles. Therefore, there is a need of a hand-powered projectile assembly which has the capacity to store and launch projectiles.

The foregoing patent and other information reflect the state of the art of which the inventor is aware and are tendered with a view toward discharging the inventor's acknowledged duty of candor in disclosing information that may be pertinent to the patentability of the technology described herein. It is respectfully stipulated, however, that the foregoing patent and other information do not teach or render obvious, singly or when considered in combination, the inventor's claimed invention.

SUMMARY OF THE INVENTION

In accordance with the teachings of present invention, a hand-powered projectile assembly is provided.

The hand-powered projectile assembly is comprised of the following components:

an elastic projectile pouch;
a hollow base ring;
a hollow locking ring; and
a cap.

In an exemplary embodiment the elastic projectile pouch is comprised of latex/rubber configured for storing and launching at least one projectile. The elastic projectile pouch includes an open end and a reinforced tip. The open end is circular in shape and the reinforced tip is configured for seating at least one of the one or more projectiles.

The hollow base ring can either be threaded or have the ability for the hollow locking ring and the cap to slide on and fasten together. The back of the hollow base ring is attached to the elastic projectile pouch. The hollow base ring may also include serrations that could be used as a cutting tool.

The hollow locking ring can either be threaded or have the ability to snap or lock to the base ring. The hollow locking ring can have a groove for the index and thumb to fit securely in place and/or a grooved pattern that prevents fingers from slipping. The hollow locking ring can sit flush with the hollow base ring to form a tight seal against the elastic projectile pouch.

The cap can either be threaded or have the ability to snap or lock to the hollow base ring to form a watertight connection. The cap assembly may further be comprised of accessories such as a compass, a whistle, a mirror, a magnifying glass, a knife, a flint, an aiming site, a laser, a light and other survival/hunting/game features.

An aspect of the technology described herein is to provide for the storing of projectiles.

Another aspect of the technology described herein is to provide a hand-powered projectile assembly that can be carried in a pocket of a user.

DETAILED DESCRIPTION OF THE INVENTION

Figure 1:
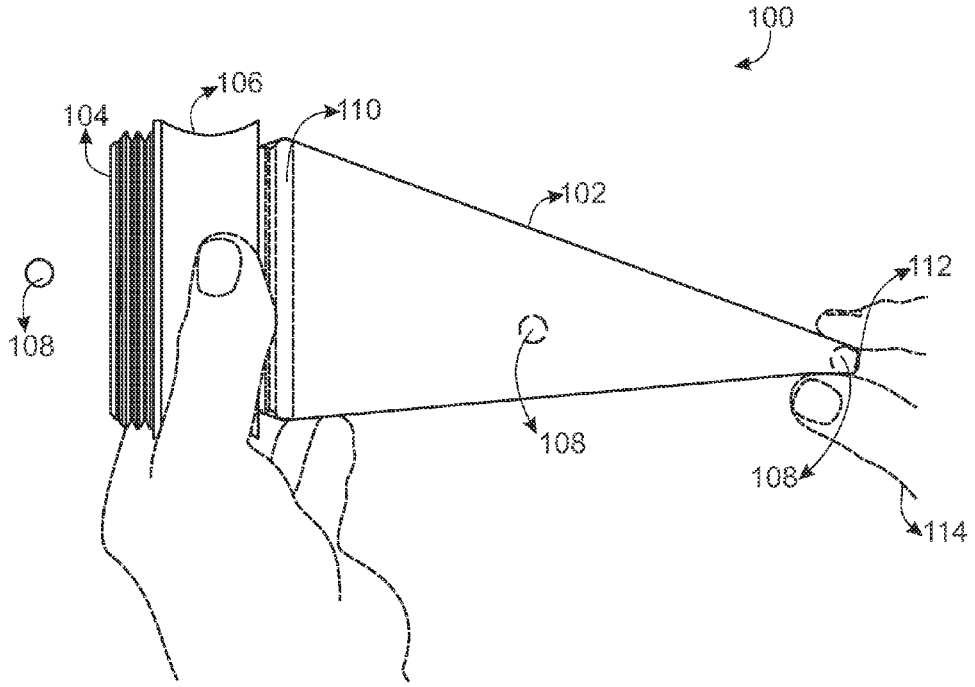
FIG. 1 illustrates a perspective view of a hand-powered projectile assembly releasing a projectile, in accordance with a preferred embodiment of the technology described herein.

While this technology is illustrated and described in a preferred embodiment, the hand-powered projectile assembly may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

Reference will now be made in detail to several embodiments of the invention which are illustrated in the accompanying drawings. Wherever feasible and convenient, the same reference numerals are used in the figures and the description to refer to the same or like parts. The drawings are in a simplified form and not to precise scale. For purposes of convenience and clarity only, directional terms, such as top, bottom, left, right, up, down, over, above, below, beneath, rear, and front may be used with respect to the accompanying drawings. These and similar directional terms should not be strictly construed to limit the scope of the invention. In addition, words such as attached, affixed, coupled, connected and similar terms with their inflectional morphemes are used interchangeably, unless the difference is noted or made otherwise clear from the context. These words and expressions do not necessarily signify direct connections, but include connections through mediate components and devices.

FIG. 1 illustrates a perspective view of a hand-powered projectile assembly 100 releasing a projectile, in accordance with a preferred embodiment of the present invention. The hand-powered projectile assembly 100 is comprised of an elastic projectile pouch 102, a hollow base ring 104 and a hollow locking ring 106. The elastic projectile pouch 102 is configured to launch and store one more projectiles 108. The elastic projectile pouch 102 in comprised of an open end 110 and a reinforced tip 112. The reinforced tip 112 is configured for seating at least one of the one or more projectiles 108. The elastic projectile pouch 102 is capable of storing the one or more projectiles 108. The storing of one or more projectiles 108 is explained in detail in conjunction with FIG. 3 of the present invention.

The hollow base ring 104 is attached to the open end 110 of the elastic projectile pouch 102. The hollow locking ring 106 is mounted around the hollow base ring 104. The hollow locking ring 106 is configured to hold the elastic projectile pouch 102 in place. The hollow locking ring 106 sits flush with the hollow base ring 104 to form a tight seal against the elastic projectile pouch 102.

The hollow locking ring 106 is further configured to facilitate the one or more projectiles 108 to exit through the open end 110 of the elastic projectile pouch 102 and the hollow base ring 104. As shown, a user 114 stretches the elastic projectile pouch 102 along with the projectile 108 seated at the reinforced tip 112. Thereafter, the user 114 releases the stretched elastic projectile pouch 102, the projectile 108 exits through the open end 110 and the hollow base ring 104 to hit a predetermined target.

Figure 2:
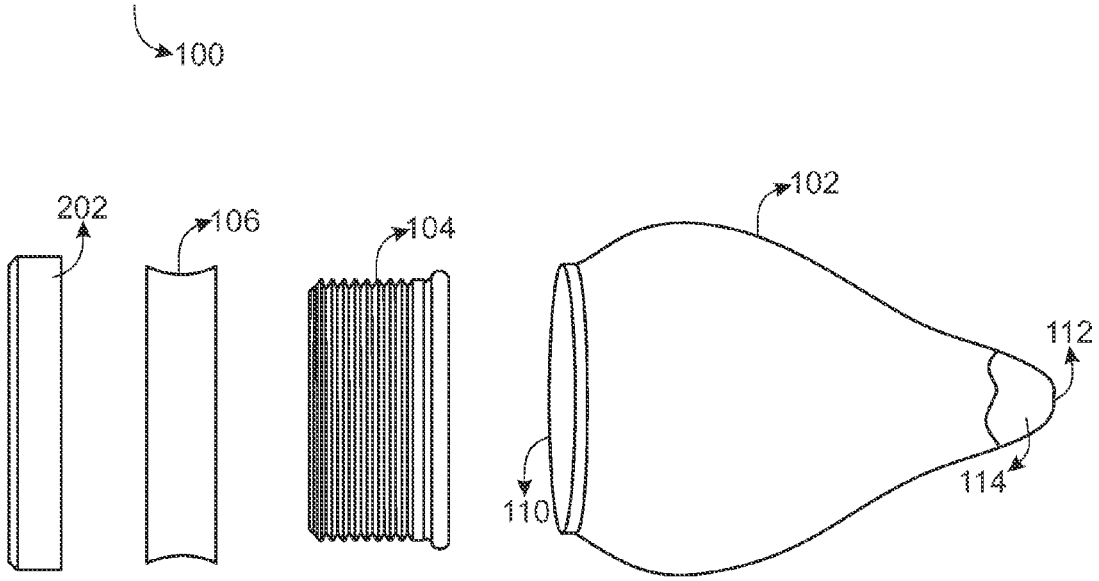
FIG. 2 illustrates an exploded view of the hand-powered projectile assembly, in accordance with a preferred embodiment of the technology described herein.

FIG. 2 illustrates an exploded view of the hand-powered projectile assembly 100, in accordance with the embodiment of the preferred invention. The hand-powered projectile assembly 100 further includes a cap 202. The cap 202 is detachably attached to the hollow base ring 104. The cap 202 facilitates storage of the one or more projectiles 108 (not shown in FIG. 2) inside the projectile pouch 102. The position of one or more projectiles 108 is shown and explained in detail in conjunction with FIG. 3 of the present invention. Various embodiments of the attachment of the cap 202 with the hollow base ring 104 and the hollow locking ring 106 is explained in detail in conjunction with FIG. 4 and FIG. 5 of the present invention.

Figure 3:
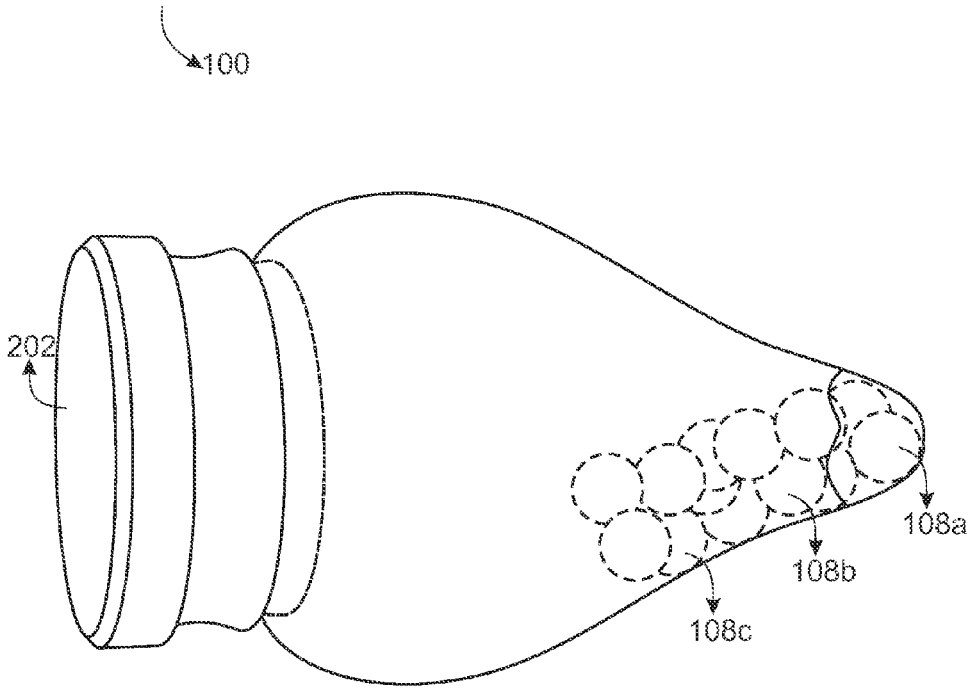
FIG. 3 illustrates a perspective view of the hand-powered projectile assembly storing one or more projectiles, in accordance with a preferred embodiment of the technology described herein.

FIG. 3 illustrates a perspective view of the hand-powered projectile assembly 100 storing one or more projectiles 108, in accordance with another preferred embodiment of the present invention. The cap 202 does not allow the one or more projectiles 108 such as 108*a*, 108*b* and 108*c* to fall from the elastic projectile pouch 102. Thus, the cap 202 maintains the position of the one or more projectile 108 inside the projectile pouch 102, when the hand-powered projectile assembly 100 is not in use. In another embodiment of the present invention, the elastic projectile pouch 102 may also acts as storage for the one or more projectile 108.

Figure 4:
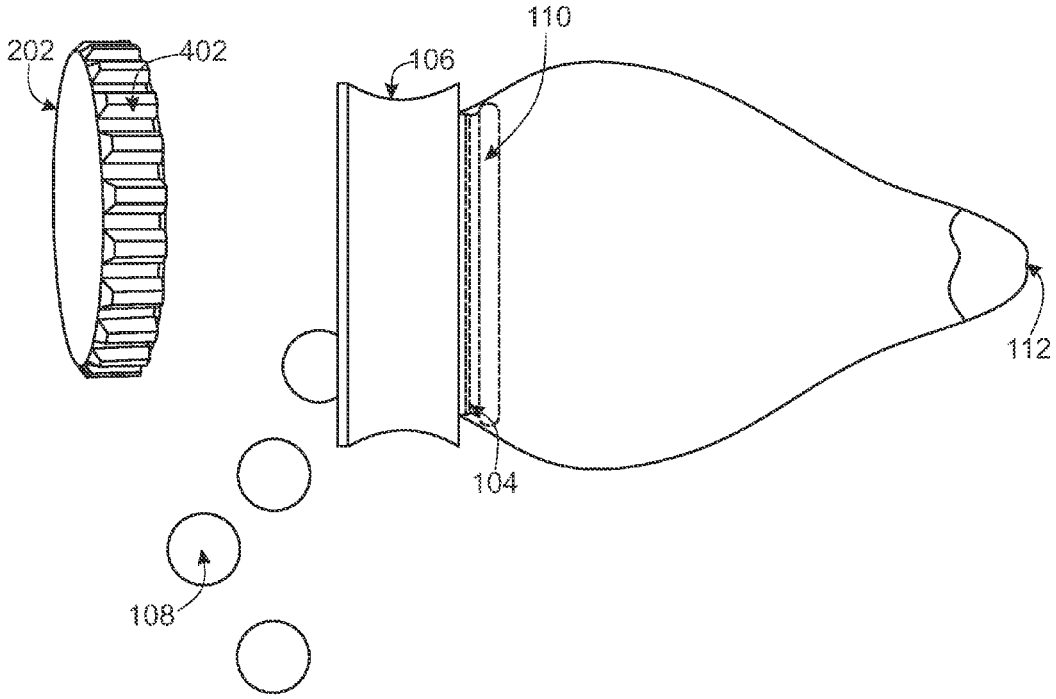
FIG. 4 illustrates a perspective view of a threaded cap with a hollow locking ring, in accordance with a preferred embodiment of the technology described herein.

FIG. 4 illustrates a perspective view of a threaded cap 202 with a hollow locking ring 106, in accordance with another preferred embodiment of the present invention. The cap 202 includes threaded 402 to form a watertight connection with the hollow locking ring 106 and the hollow base ring 104. When the cap 202 is open the one or more projectiles 108 may be taken out and further be replaced with other projectiles 108.

Examples of one or more projectiles 108 include but not limited to BB's, airsoft, paintballs, rocks, marbles, balls, snap and pops, marshmallows/candy, nuts, fish food, confetti, etc. However, it will be readily apparent to those with ordinary skill in the art that various color, shape and size of the projectiles 108 may be formed and used with the hand-powered projectile assembly 100, without deviating from the scope of the invention.

Figure 5:
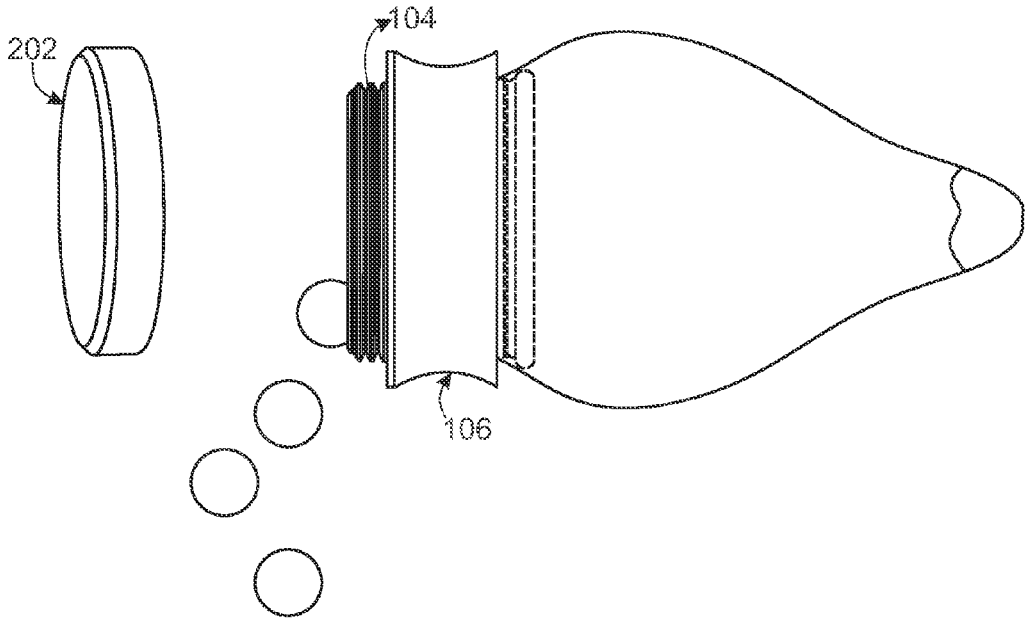
FIG. 5 illustrates a perspective view of a cap with a threaded hollow base ring and a hollow locking ring, in accordance with a preferred embodiment of the technology described herein.

FIG. 5 illustrates a perspective view of a cap 202 with threaded hollow base ring 104 and hollow locking ring 106, in accordance with another preferred embodiment of the present invention. The hollow base ring 104 is threaded to form a watertight connection with the cap 202. The cap 202 can have the ability to snap fit to the hollow base ring 104.

Figure 6A:
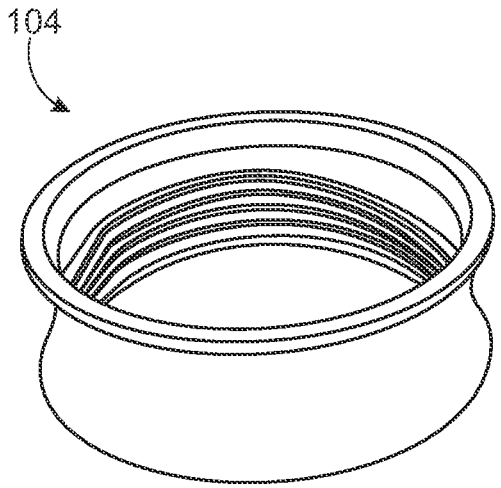
FIGS. 6*a* and 6*b* illustrates a perspective view of a hollow base ring and a hollow locking ring respectively, in accordance with a preferred embodiment of the technology described herein.
Figure 6B:
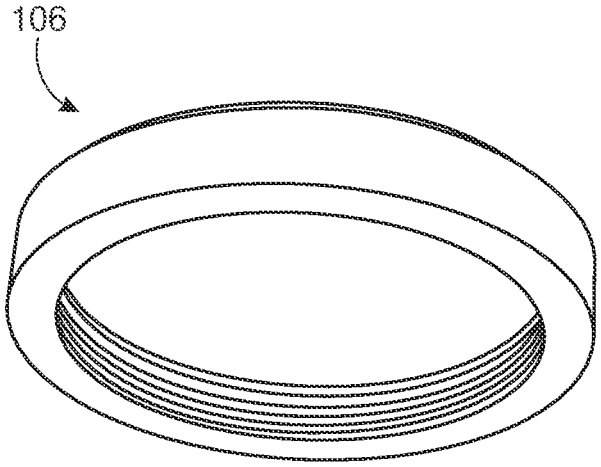

FIG. 6*a* and FIG. 6*b* illustrates a perspective view of the hollow base ring 104 and the hollow locking ring 106 respectively, in accordance with another preferred embodiment of the present invention. As shown in FIG. 6*a*, the hollow base ring 104 is threaded to maintain a watertight connection with either the cap (not shown in FIG. 6*a*) or the elastic projectile pouch (not shown in FIG. 6*a*). The hollow base ring 104 may be constructed with the materials including, but not limited to, plastic, aluminum, metal or polyvinyl carbon.

The shape of the hollow base ring 104 includes, but not limited to, circular, oval, triangle, square, rectangle, octagon, nonagon, decagon, duo decagon, or any shape that forms a 360 degree opening. The threads or serrations form on the hollow base ring 104 may also be used as a cutting tool. However, it will be readily apparent to those with ordinary skill in the art that various color, shape and size of the hollow base ring 106 may be formed and used with the hand-powered projectile assembly 100, without deviating from the scope of the invention.

As shown in FIG. 6*b*, the hollow locking ring 106 includes threads to flock or snap-fit with the hollow base ring 104. The hollow locking ring 106 may be constructed with the materials including but not limited to plastic, aluminum, metal or polyvinyl carbon. The shape of the hollow base ring 106 includes but not limited to circular, oval, triangle, square, rectangle, octagon, nonagon, decagon, duo decagon, or any shape that forms a 360 degree ring. However, it will be readily apparent to those with ordinary skill in the art that various color, shape and size of the hollow locking ring 106 may be formed and used with the hand-powered projectile assembly 100, without deviating from the scope of the invention.

Figure 7:
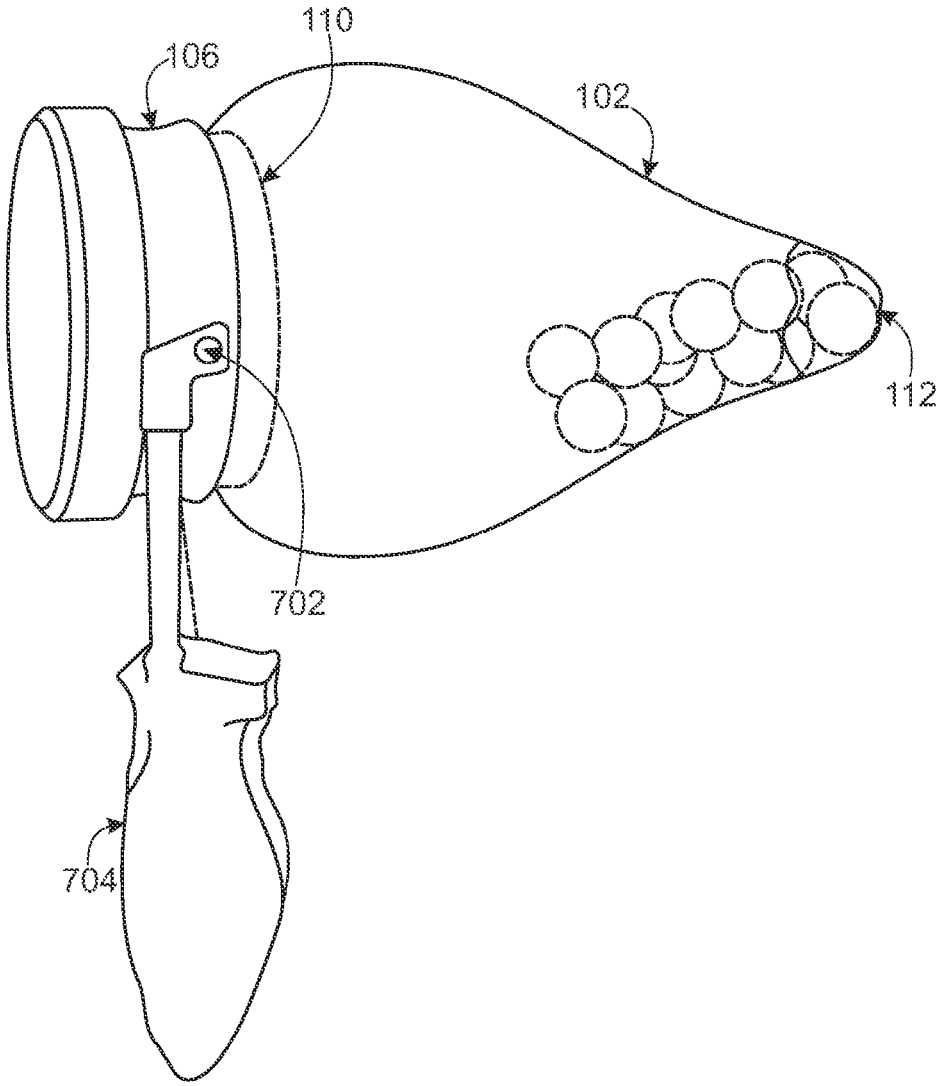
FIG. 7 illustrates a perspective view of a hand-powered projectile assembly with an attachment, in accordance with a preferred embodiment of the technology described herein.

FIG. 7 illustrates a perspective view of the hand-powered projectile assembly with an attachment, in accordance with another preferred embodiment of the present invention.

The hollow locking ring 106 includes one or more means 702 for attaching one or more attachments 704. Another embodiment of one or more means 702 and one or more attachments 704 is explained in detailed in conjunction with FIG. 8 of the present invention.

In a preferred embodiment of the present invention, the elastic projectile pouch 102 may be made up of latex or rubber. The shape of the elastic projectile pouch 102 includes but not limited to circular, oval, triangle, square, rectangle, octagon, nonagon, decagon, duo decagon, or any shape that forms an opening. The open end 110 has a circular shaped similar to a rubber washer/gasket. The reinforced tip 112 is made up of a thicker latex, rubber or cotton fibers. However, it will be readily apparent to those with ordinary skill in the art that various color, shape and size of the projectile pouch 102, open end 110 and reinforced tip 112 may be formed and used with the slingshot device 100, without deviating from the scope of the invention.

Figure 8:
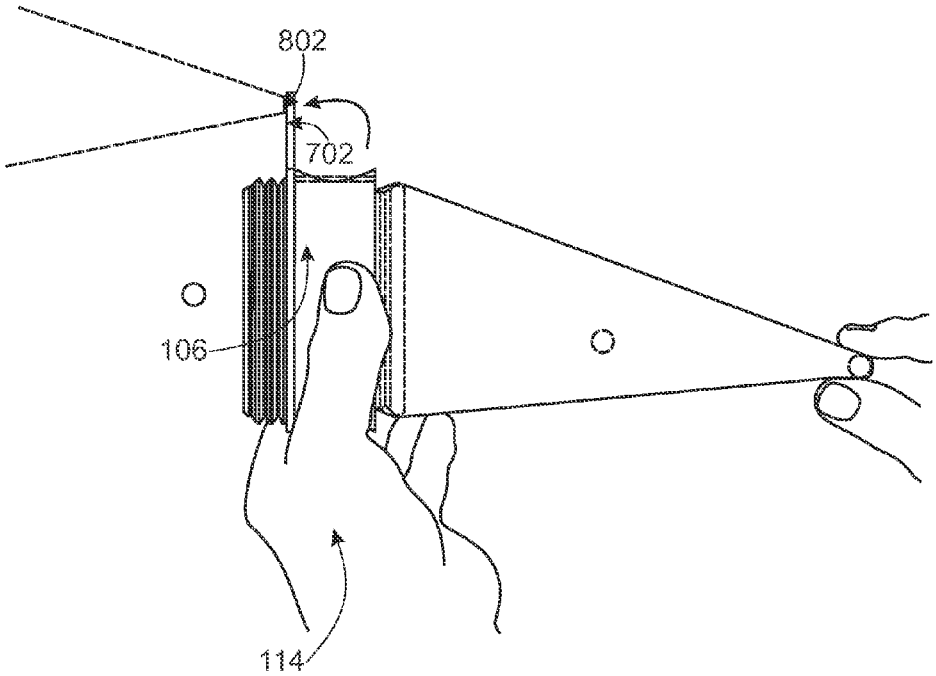
FIG. 8 illustrates a perspective view of a hand-powered projectile assembly releasing a projectile with a laser pointer, in accordance with a preferred embodiment of the technology described herein.

FIG. 8 illustrates a perspective view of a hand-powered projectile assembly 100 releasing a projectile 108 with a laser pointer, in accordance with another preferred embodiment of the present invention. With the reference of FIG. 7, another embodiment of one or more means 702 and one or more attachments 704 is explained in FIG. 8 of the present invention. In a preferred embodiment, the attachment 704 is a laser pointer 802. Examples of the one or more attachments 704 include but not limited to lights, circular eye, fish rod eye, camera, fish line, aiming sight etc. In another preferred embodiment of the present invention, the hollow locking ring 106 further includes grooves or threads to place either finger or thumb of a user 114 in a secure manner.

Figure 9A:
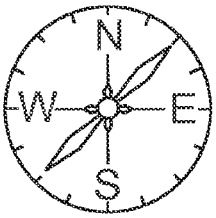
FIGS. 9*a*, 9*b*, 9*c*, 9*d* and 9*e* illustrates front plan views of various cap accessories, in accordance with a preferred embodiment of the technology described herein.
Figure 9B:
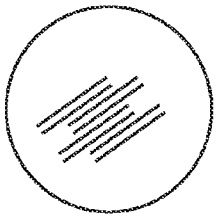
Figure 9C:
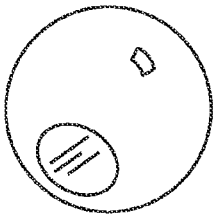
Figure 9D:
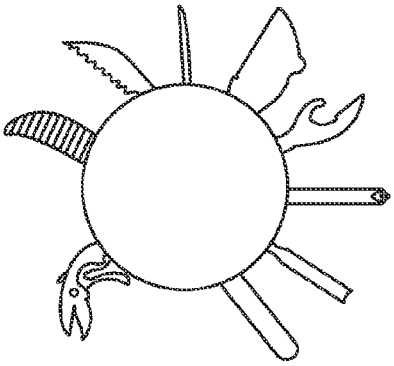
Figure 9E:
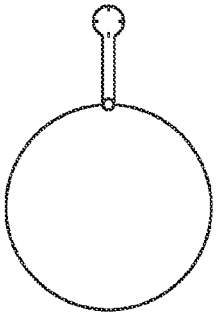

FIGS. 9*a*, 9*b*, 9*c*, 9*d* and 9*e* illustrates front plan views of various cap accessories, in accordance with another preferred embodiment of the present invention. The cap 202 further includes attachment means for one or more accessories 900 such as a compass 902 (as shown in FIG. 9*a*), a mirror 904 (as shown in FIG. 9*b*), a store 906 for projectiles 108 (as shown in FIG. 9*c*), a Swiss knife 908 (as shown in FIG. 9*d*) and a magnifying glass 910 (as shown in FIG. 9*e*). Various other accessories 900 may also be used but not limited to whistle, laser, light, flint, knife and an aiming site.

The cap 202 may be constructed with the materials including but not limited to plastic, aluminum, metal or polyvinyl carbon. The shape of the cap 202 includes but not limited to circular, oval, triangle, square, rectangle, octagon, nonagon, decagon, duo decagon, or any shape that forms a 360 degree ring. However, it will be readily apparent to those with ordinary skill in the art that various color, shape and size of the cap 202 may be formed and used with the hand-powered projectile assembly 100, without deviating from the scope of the invention.

The hand-powered projectile assembly offers various advantages. The present invention provides a convenient and versatile alternative to other slingshots. Further, the present invention offers the ability to store projectiles when the hand-powered projectile assembly is not in use. The present invention may be used for hunting, fishing, competitions (like target shooting, dart games, paintballs), self-defense, pest control and for law enforcement. The hand-powered projectile assembly may also be carried easily in a user's pocket.

The foregoing discussion discloses and describes merely exemplary embodiments of the present invention. One skilled in the art will readily recognize from such discussion and from the accompanying drawings that various changes, modifications and variations can be made therein without departing from the spirit and scope of the invention.

The invention claimed is:

1. A hand-powered projectile assembly to launch one or more projectiles, the hand-powered projectile assembly comprising:

an elastic projectile pouch having an inner surface, an outer surface, an open end and a reinforced tip, wherein the reinforced tip is configured for seating at least one of the one or more projectiles;

a hollow base ring attached to the open end of the elastic projectile pouch; and a hollow locking ring mounted around the hollow base ring, the hollow locking ring configured for holding the elastic projectile pouch in place, the hollow locking ring configured for facilitating the one or more projectiles to exit through the open end of the elastic projectile pouch and the hollow base ring, wherein the inner surface of the pouch engages the hollow being ring.

2. The hand-powered projectile assembly according to claim 1, wherein the hollow locking ring further comprises either threads or grooves for placing either fingers or thumb of a user in a secure manner.

3. The hand-powered projectile assembly according to claim 1, wherein the hollow locking ring comprises a watertight connection with the base ring.

4. The hand-powered projectile assembly according to claim 1, wherein the hollow locking ring further comprises an aiming sight.

5. The hand-powered projectile assembly according to claim 1 further comprises a cap detachably attached to the hollow base ring, the cap to maintain position of the one or more projectiles inside the elastic projectile pouch.

6. The hand-powered projectile assembly according to claim 5, wherein the hollow base ring comprises a watertight connection with the cap.

7. The hand-powered projectile assembly according to claim 5, wherein the cap further comprises attachment means to attach one or more accessories.

8. The hand-powered projectile assembly according to claim 7, wherein the one or more accessories comprises a compass.

9. The hand-powered projectile assembly according to claim 7, wherein the one or more accessories comprises a mirror.

10. The hand-powered projectile assembly according to claim 7, wherein the one or more accessories comprises a swiss knife.

11. The hand-powered projectile assembly according to claim 7, wherein the one or more accessories comprises a magnifying glass.

12. The hand-powered projectile assembly according to claim 1, wherein the hollow base ring contacts the hollow locking ring.

13. A hand-powered projectile assembly to launch one or more projectiles, hand-powered projectile assembly comprising:

an elastic projectile pouch having an open end and a reinforced tip, the reinforced tip configured for seating at least one of the one or more projectiles;

a hollow base ring attached to the open end of the elastic projectile pouch;

a hollow locking ring mounted around the base ring, the hollow locking ring configured for holding the elastic projectile pouch in place, the hollow locking ring configured for facilitating the one or more projectile to exit through the open end of the elastic projectile pouch and the hollow base ring; and a cap detachably attached to the hollow base ring, the cap to maintain the position of one or more projectiles inside the projectile pouch.

14. The hand-powered projectile assembly according to claim 13, wherein the hollow locking ring further comprises either threads or grooves for placing either fingers or thumb of a user in a secure manner.

15. The hand-powered projectile assembly according to claim 13, wherein the hollow locking ring comprises a water-tight connection with the base ring.

16. The hand-powered projectile assembly according to claim 13, wherein the hollow locking ring further comprises an aiming sight.

17. The hand-powered projectile assembly according to claim 13, wherein the hollow base ring to form a watertight connection with the cap.

18. The hand-powered projectile assembly according to claim 13, wherein the cap further comprises attachment means to attach one or more accessories.

19. The hand-powered projectile assembly according to claim 13, wherein the one or more accessories comprises a compass.

20. The hand-powered projectile assembly according to claim 13, wherein the one or more accessories comprises a mirror.

21. The hand-powered projectile assembly according to claim 13, wherein the one or more accessories comprises either a knife or magnifying glass.

* * * * *

UNITED STATES PATENT AND TRADEMARK OFFICE

CERTIFICATE OF CORRECTION

PATENT NO. : 8,925,535 B2
APPLICATION NO. : 13/712953
DATED : January 6, 2015
INVENTOR(S) : Phillips It is certified that error appears in the above-identified patent and that said Letters Patent is hereby corrected as shown below:

In the claims:

Column 6,
Lines 17 and 18, "hollow being ring." should read --hollow base ring.--.

Signed and Sealed this
Twenty-first Day of April, 2015

Michelle K. Lee

Michelle K. Lee
*Director of the United States Patent and Trademark Office*